US008490616B2

(12) United States Patent
Venezia et al.

(10) Patent No.: US 8,490,616 B2
(45) Date of Patent: Jul. 23, 2013

(54) BUILT-IN OVEN

(75) Inventors: Michele Venezia, Taino (IT); Marco Giuliani, Travedona Monate (IT); Cristina Mazzetti, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 610 days.

(21) Appl. No.: 12/413,838

(22) Filed: Mar. 30, 2009

(65) Prior Publication Data

US 2009/0255524 A1 Oct. 15, 2009

(30) Foreign Application Priority Data

Apr. 10, 2008 (EP) ..... 08103476

(51) Int. Cl.
*F23M 7/00* (2006.01)

(52) U.S. Cl.
USPC ..... 126/190; 126/198; 126/193; 126/200

(58) Field of Classification Search
USPC ..... 126/190, 193, 198, 200
See application file for complete search history.

(56) References Cited

U.S. PATENT DOCUMENTS

| | | | | | |
|---|---|---|---|---|---|
| 2,314,596 | A | * | 3/1943 | Pellegrin et al. | 16/431 |
| 3,208,446 | A | * | 9/1965 | Hopkins et al. | 126/220 |
| 3,294,463 | A | * | 12/1966 | Kafferlin et al. | 312/234.5 |
| 3,828,763 | A | * | 8/1974 | Wilson | 126/200 |
| 3,939,817 | A | * | 2/1976 | Nuss | 126/190 |
| 4,383,519 | A | * | 5/1983 | Katona | 126/190 |
| 4,662,114 | A | * | 5/1987 | Suttles | 49/501 |
| 4,716,884 | A | * | 1/1988 | Bonaccorsi et al. | 126/198 |
| D297,490 | S | * | 9/1988 | Suttles | D6/492 |
| 5,314,668 | A | * | 5/1994 | Biermaier | 422/292 |
| 5,500,508 | A | * | 3/1996 | Gerl | 219/400 |
| 6,561,180 | B1 | * | 5/2003 | Austin et al. | 126/198 |
| 6,666,219 | B2 | * | 12/2003 | Raches | 134/57 D |
| 6,904,904 | B2 | * | 6/2005 | Walther et al. | 126/198 |
| 7,478,502 | B2 | * | 1/2009 | Bienick et al. | 52/205 |
| 2004/0232133 | A1 | * | 11/2004 | Roch et al. | 219/393 |
| 2005/0076900 | A1 | * | 4/2005 | Walther et al. | 126/198 |
| 2005/0092318 | A1 | * | 5/2005 | Haustein et al. | 126/200 |
| 2007/0251520 | A1 | * | 11/2007 | Bang | 126/200 |

FOREIGN PATENT DOCUMENTS

| | | | | |
|---|---|---|---|---|
| DE | 2810123 | A | * | 9/1979 |
| DE | 2829720 | A | * | 1/1980 |
| DE | 3014908 | | | 10/1981 |
| DE | 19738506 | C1 | * | 3/1999 |
| DE | 10314214 | | | 10/2004 |
| EP | 499803 | | | 8/1992 |
| EP | 532393 | | | 3/1993 |
| EP | 811806 | | | 12/1997 |
| EP | 947776 | | | 10/1999 |
| EP | 1069378 | | | 1/2001 |
| EP | 1777462 | A2 | * | 4/2007 |
| GB | 2013872 | A | * | 8/1979 |
| JP | 59027135 | A | * | 2/1984 |
| JP | 59044529 | A | * | 3/1984 |
| WO | WO 2006064457 | A1 | * | 6/2006 |

* cited by examiner

*Primary Examiner* — Kenneth Rinehart
*Assistant Examiner* — Jorge Pereiro

(57) ABSTRACT

A built-in oven comprises a door and a ventilation system. The door structure comprises two vertical frame elements and an upper hollow frame element mounted on the vertical elements and on upper edges of two or more glass plates and having a front aperture adapted to be used as an handle of the door flush with the front surface thereof, the upper hollow frame element being used as part of the ventilation system of the oven.

17 Claims, 3 Drawing Sheets

BUILT-IN OVEN

BACKGROUND OF THE INVENTION

1. Field of the Invention

The present invention relates to a built-in oven comprising a door. More particularly the present invention relates to a domestic built-in oven having an air cooling system. More specifically the invention is related to the inlet area of the ventilation system and the flow path of the air inside the door of the appliance.

2. Description of the Related Art

The ventilation system inlet/outlet are usually located between the oven door and the control panel: this forces the designer to provide a high gap between these two components, thus creating several issues. From this opening small objects can be accidentally inserted into the ventilation system, blocking the cooler fan or simply stay in place and creating bad smell over time. This gap between the door and the control system (leaving aside the aesthetical problems deriving from this gap which interrupts the continuity of the front surface of the oven inserted in the kitchen furniture) is also highly increasing the possibility for any dirt or liquid to flow inside the oven door.

SUMMARY OF THE INVENTION

An aspect of the present invention is to provide a specific handle design that is integrated into the door thickness and that can solve the above problem of the gap between the control panel and the door.

The above aspect is reached thanks to the features listed in the appended claims.

According to the invention, it is now possible to create an opening into the door in order to define a ventilation system inlet point without the need of having big gaps between door and control panel as in the known ovens.

BRIEF DESCRIPTION OF THE DRAWINGS

Further advantages and features according to the present invention will be clear from the following detailed description provided by way of non-limiting example, with reference to the attached drawings in which.

DETAILED DESCRIPTION OF THE PREFERRED EMBODIMENTS

Figure 1:
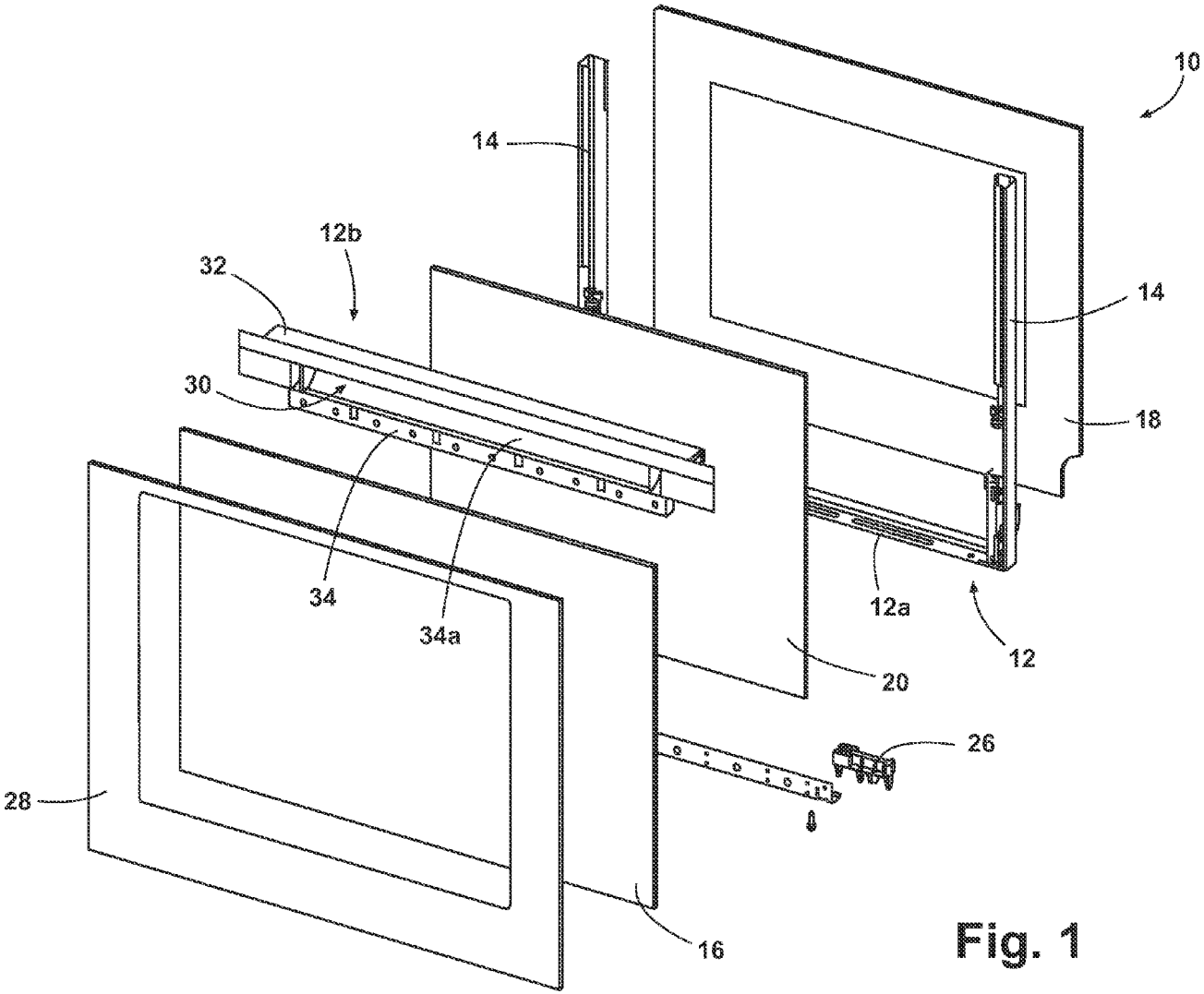
FIG. 1 is a perspective exploded view of a door of an oven according to the invention.
Figure 3:
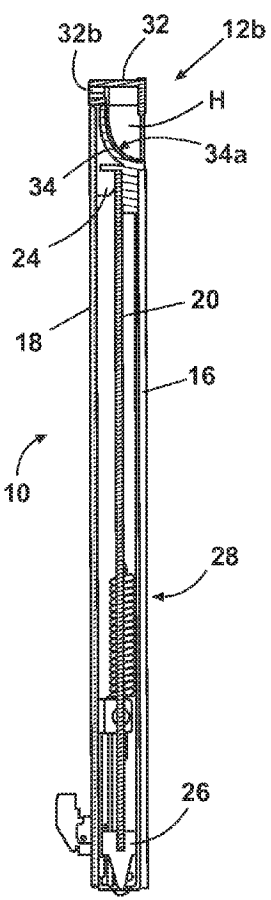
FIG. 3 is a section view taken along line III-III of FIG. 2.
Figure 2:
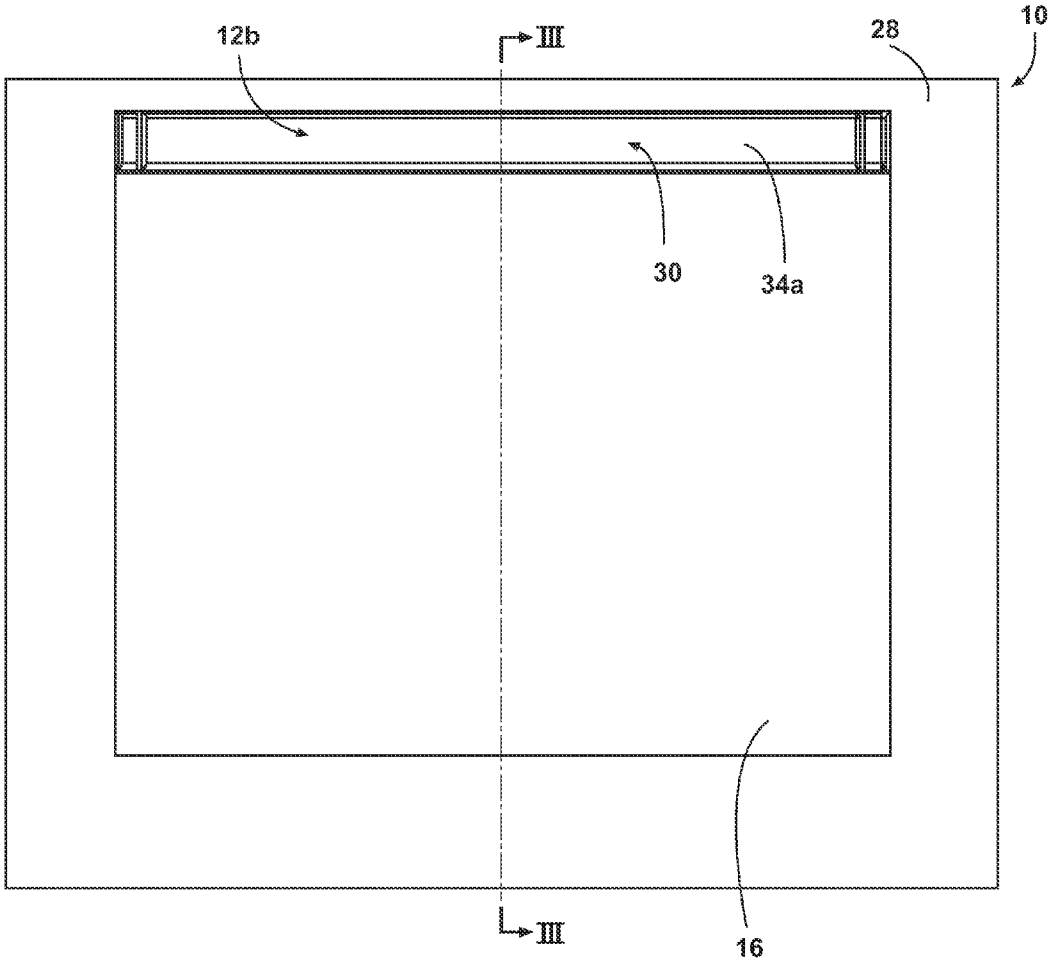
FIG. 2 is a front view of the oven door of FIG. 1.

With reference to the drawings, a door 10 of a built-in oven B comprises a frame 12 composed of a U-shaped element 12*a* and of a rectilinear upper hollow element 12*b* fixed to the upper ends of two vertical profiles 14 being part of the U-shaped element 12*a*. The upper hollow element 12*b* may be made of polymeric material, for instance an engineering polymer. On the front and rear face of the frame 12 (with reference to the usual working configuration of the door 10 installed on the oven B) are fixed, in a known manner, an external and an internal glass plate respectively 16 and 18. Between these two glass plates 16 and 18, and intermediate glass plate 20 is installed in the frame 12, at a predetermined distance from the external glass plate 16 and from the internal glass plate 18 respectively. For maintaining the predetermined distance the upper hollow element 12*b* is provided with comb-shaped portions 24 in which the upper edge of the intermediate glass plate 20 is inserted. Similarly, in the lower portion of the door, between the external glass plate 16 and the internal glass plate 18 there are positioned spacer elements 26 (FIGS. 1 and 3). On the external glass plate 16 a decorative rectangular frame 28 is fixed, for instance by means of an adhesive. It is clear from the above that the "sandwiched" assembly of the frame 12 with the glass plates 16, 18 and 20 defines a closed insulated wall which prevents the external glass plate 16 from reaching high temperatures when the oven is used, particularly during the pyrolitic cycle thereof.

Figure 4:
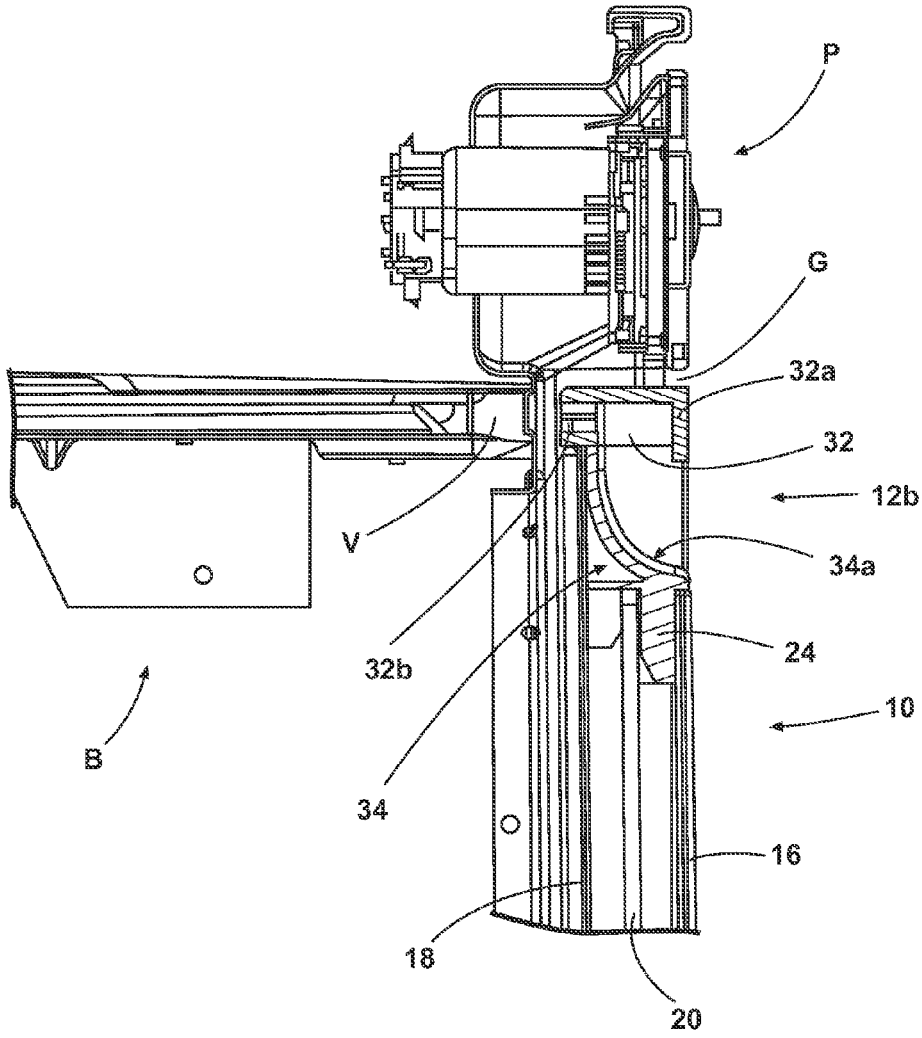
FIG. 4 is an enlarged section view of a detail of the door of FIGS. 1-3 in the configuration installed on a built-in oven.

The upper hollow element 12*b* of the frame 12 presents a front aperture 30 and it comprises an upper U-shaped rectilinear portion 32 which define a front edge 32*a* which is used as an handle by the user. The rear portion of the U-shaped portion 32 presents a plurality of apertures 32*b* in form of slots which are facing an inlet (or outlet) opening V of the ventilation system of the oven B. The upper hollow element 12*b* of the frame 12 presents a lower portion 34 with a curved surface 34*a* which has the function not only of defining an hollow space H for the fingers of the user when he/she wants to open the door 10, but also as part of the ventilation system for conveying an air flow towards the inlet opening V without a sensible pressure drop. Due to the air passage across the upper hollow element 12*b* defining the handle of the door, the gap G (FIG. 4) between a control panel P of the oven B and the upper edge of the door 10 can be kept very low, i.e. the minimum distance sufficient for compensating mounting tolerances of the door 10 on the oven structure. At the same time the air flow across the upper hollow element 12*b* maintains the temperature of the "handle" at very low levels, close to the ambient temperature.

In the embodiment shown in the drawings, the upper hollow element 12*b* is flush with the outside surface of the door 10, therefore providing an even surface which is very easy to be cleaned by the user.

Even if in the described example the upper hollow element 12*b* is shown as an elongated member, the actually hollow portion of the element can be reduced in length without departing from the scope of the present invention.

We claim:

1. An oven door for providing access to an oven cavity comprising:

a frame including opposing vertical elements connected by a bottom element and an upper hollow element, with the upper hollow element having an upper portion and a lower portion, the upper portion of the upper hollow element being defined by a front edge member which is connected to but spaced from a rear section, the lower portion of the upper hollow element including a rear wall surface connected to the upper portion and spaced from the front edge member so as to define a hollow space within which fingers of a user can be inserted in order to engage the front edge member such that the front edge member establishes a handle for the oven door, the rear section of the upper portion including a plurality of apertures which are open to the hollow space and extend through the rear section to enable fluid communication with a ventilation system for cooling about an oven cavity;

an external glass plate fixed to a front face of the frame, wherein the lower portion of the upper hollow element is provided with a plurality of comb-shaped elements, at least some of which are engaged by the external glass plate; and an internal glass plate fixed to a rear face of the frame, wherein the rear section of the upper hollow element projects rearward of the internal glass plate.

2. The oven door according to claim 1, wherein the rear wall surface is curved so as to connect the lower portion of the upper hollow element directly to the rear section of the upper portion, while being spaced from the front edge member by the hollow space.

3. The oven door according to claim 2, wherein the front edge member is substantially flush with the external glass plate.

4. The oven door according to claim 1, wherein the external glass plate terminates below the rear wall surface, while the internal glass plate extends to the upper hollow element.

5. The oven door according to claim 1, further comprising: an intermediate glass plate arranged between the external and internal glass plates, the intermediate glass plate including an upper edge inserted between the plurality of comb-shaped elements.

6. The oven door according to claim 1, wherein the internal glass plate is located entirely behind both the comb-shaped elements and the rear wall surface.

7. The oven door according to claim 1, further comprising: a decorative frame fixed to an outer surface of the external glass panel.

8. The oven door according to claim 1, wherein the upper hollow element is made of polymeric material.

9. An oven comprising:

an oven cavity;

a ventilation system for cooling about the oven cavity, the ventilation system including an upper frontal opening for ventilation air; and an oven door for providing access to the oven cavity, said oven door including:

a frame having opposing vertical elements connected by a bottom element and an upper hollow element, with the upper hollow element having an upper portion and a lower portion, the upper portion of the upper hollow element being defined by a front edge member which is connected to but spaced from a rear section, the lower portion of the upper hollow element including a rear wall surface connected to the upper portion and spaced from the front edge member so as to define a hollow space within which fingers of a user can be inserted in order to engage the front edge member such that the front edge member establishes a handle for opening the oven door to provide access to the oven cavity, the rear section of the upper portion including a plurality of apertures which are open to the hollow space and extend through the rear section to provide fluid communication, at a location behind the oven door, with the upper frontal opening of the ventilation system;

an external glass plate fixed to a front face of the frame, wherein the lower portion of the upper hollow element is provided with a plurality of cob-sped elements, at least some of which are engaged by the external glass plate; and an internal glass plate fixed to a rear face of the frame.

10. The oven according to claim 9, wherein the rear wall surface is curved so as to connect the lower portion of the upper hollow element directly to the rear section of the upper portion, while being spaced from the front edge member by the hollow space.

11. The oven according to claim 10, wherein the front edge member is substantially flush with the external glass plate.

12. The oven according to claim 9, wherein the external glass plate terminates below the rear wall surface, while the internal glass plate extends to the upper hollow element.

13. The oven according to claim 9, further comprising: an intermediate glass plate arranged between the external and internal glass plates, the intermediate glass plate including an upper edge inserted between the plurality of comb-shaped elements.

14. The oven according to claim 9, wherein the internal glass plate is located entirely behind both the comb-shaped elements and the rear wall surface.

15. The oven according to claim 14, wherein the rear section of the upper hollow element projects rearward of the internal glass plate.

16. The oven according to claim 9, further comprising: a decorative frame fixed to an outer surface of the external glass panel.

17. The oven according to claim 9, wherein the oven is a built-in oven.

* * * * *